United States Patent [19]

Sedgeley et al.

[11] Patent Number: 4,995,771

[45] Date of Patent: Feb. 26, 1991

[54] APPARATUS AND METHOD FOR DEBAGGING ARTICLES

[75] Inventors: William A. Sedgeley; Ronald L. Moore, both of Golden, Colo.

[73] Assignee: Adolph Coors Company, Golden, Colo.

[21] Appl. No.: 470,822

[22] Filed: Jan. 26, 1990

[51] Int. Cl.[5] ..... B65B 69/00

[52] U.S. Cl. ..... 414/412; 53/381 R; 83/280; 414/786

[58] Field of Search ..... 414/412, 411, 416, 417, 414/786; 83/719–721, 728, 409, 409.1, 418; 53/381 R, 492

[56] References Cited

U.S. PATENT DOCUMENTS

| | | | |
|---|---|---|---|
| 3,441,156 | 4/1969 | Bofinger et al. | 414/412 |
| 3,686,820 | 9/1972 | Zenger et al. | 53/3 |
| 4,158,417 | 6/1979 | Inoue | 414/412 |
| 4,212,213 | 7/1980 | Wolfelsberger et al. | 83/418 |
| 4,245,946 | 1/1981 | McCullough et al. | 414/412 |
| 4,457,123 | 7/1984 | Hoehn | 414/412 X |
| 4,466,767 | 8/1984 | Meschi | 414/411 |
| 4,778,044 | 10/1988 | Kondo | 83/280 |
| 4,938,649 | 7/1990 | Horst et al. | 414/412 |

FOREIGN PATENT DOCUMENTS

| | | | |
|---|---|---|---|
| 1330022 | 8/1987 | U.S.S.R. | 414/412 X |
| 2010771A | 7/1979 | United Kingdom | 414/412 |

*Primary Examiner*—Robert J. Spar
*Assistant Examiner*—Brian Dinicola
*Attorney, Agent, or Firm*—Klaas & Law

[57] ABSTRACT

Apparatus and method for debagging container ends from a package comprising two superposed continuous webs having a plurality of sealed compartments formed therein by two continuous end sealing strips and a plurality of widthwise extending sealing strips extending between and into the end sealing strips wherein a portion of each end sealing strip is cut away to form a cut compartment having an open end, then holding the cut compartment to prevent widthwise movement thereof, applying a force in one direction to expose an end container end, applying a force in the opposite direction to push the container ends out of the held cut compartment and onto a receiving and transferring unit and transferring the container ends to a conveying apparatus leading to further processing apparatus.

35 Claims, 10 Drawing Sheets

APPARATUS AND METHOD FOR DEBAGGING ARTICLES

FIELD OF THE INVENTION

This invention relates generally to automated article handling equipment and more particularly to the removal or debagging of articles, such as container ends, from a plurality of interconnected sealed compartments.

BACKGROUND OF THE INVENTION

In the manufacture of containers, such as aluminum soft drink and beer containers, the ends, or tops, of the can are manufactured in a stamping and scoring operation in a conversion press, where they are provided with beaded rims "pop-tops", and so forth. The generally flat disc ends are stacked in bottom relationship and packaged in paper bags. In one operation, the bags are formed as a plurality of interconnected sealed compartments which are formed by superposing two continuous webs of a flexible material having opposite edges, inserting a plurality of container ends between them and forming a continuous end sealing strip next adjacent to each edge portion and a plurality of spaced apart widthwise extending sealing strips extending between and into the continuous end sealing strips. Each sealed compartment comprises a central body portion in which the container ends are located, two end wall portions, two end sealing strips, two widthwise sealing strips and two opposite end portions, each of which comprises portions of the two superposed continuous webs located between an end sealing strip and the end wall portions of the central body portion. In order to use the container ends in a further operation, such as a seamer apparatus, it is necessary to remove or debag the container ends from the sealed compartments.

BRIEF DESCRIPTION OF THE INVENTION

This invention provides apparatus and method for removing or debagging of articles, such as container ends, from each sealed compartment, formed as described above, by cutting the two opposite end portions of the two superposed continuous webs of flexible material, holding the widthwise extending sealing strips on each side of the container ends to prevent widthwise movement of the cut compartment, pushing the container ends out of the cut compartment into a receiving station and transferring the container ends to a discharge means leading to a further processing apparatus.

In a preferred embodiment of the invention, an endless conveyor, having dividing means for forming a plurality of separate holding units thereon, is mounted on a support structure and is moved in incremental amounts by a conventional indexing apparatus. The container end package comprising the interconnected sealed compartments is fed from a pallet onto the endless conveyor so that the central body portion of one sealed compartment is in each holding unit with the widthwise extending sealing strips in contact with portions of the dividing means. Each end portion of a sealed compartment projects outwardly from each end of the holder unit. In order to ensure the proper orientation of the sealed compartment in a holding unit, a first side guide is mounted on the support structure and has a generally planar abutment surface extending generally parallel to the direction of movement of the endless conveyor and located relative to the endless conveyor so that when the end wall portion of the central body portion of the sealed compartment is located against the abutment surface, the sealed compartment is in the proper orientation. Force applying means are provided for pushing the central body portion in a widthwise direction so that the lower portion of one end wall portion of the central body portion is against the abutment surface. The first side guide also has a generally planar surface that is perpendicular to the abutment surface and extends in a direction parallel thereto. One of the opposite end portions of a sealed compartment in a holding unit overlies at least a portion of the generally planar surface. A second side guide is mounted on the support structure and has a generally planar surface that lies in the same plane as the generally planar surface of the first side guide and is parallel thereto. The generally planar surface of the second side guide is located so that the other of the opposite end portions of a sealed compartment in a holding unit overlies at least a portion of the generally planar surface of the second side guide.

Cutting assemblies are mounted on the support structure and are located on each side of the endless conveyor. Each cutting assembly has a base plate member having a generally planar surface located so that one of the opposite end portions of a sealed compartment in a holding unit passes thereover and lies in the same plane as the generally planar surfaces of the first and second side guides. A slot extending in the direction of movement of the endless conveyor is formed in each base plate member. Knife means are located above each base plate member and comprise a clamping block which moves into contact with at least the end sealing strip of the compartment in a holding unit to clamp it against the base plate to prevent movement thereof. A cutting knife is then moved through one of the opposite end portions so that the end sealing strip is severed therefrom. The cutting knife has an arcuate cross-sectional configuration, the chord of which is parallel to the direction of movement of the endless conveyor, and has an arcuate extent that is greater than the complete distance between the widthwise extending sealing strips on the opposite sides of the compartment in a holding unit so that the knife edge passes completely through the widthwise extending sealing strips and portions of successive cuts overlap.

After the cutting operation has been completed, the cut compartment is indexed through one or more incremental amounts into a removal station for removing the container ends from the central body portion. At the removal station, a clamping member is moved against the widthwise extending sealing strips on the opposite sides of the cut compartment so as to clamp them between the clamping means and divider cogs of the dividing means forming a holding unit to prevent widthwise movement of the cut compartment. A push back force is applied to the other end wall portion of the central body portion to move the container ends toward the one end wall portion of the central body portion so that one of the opposite end portions of the superposed two continuous webs are moved apart to expose the surface of the end container end in the central body portion. A force is then applied to the exposed surface to push the container ends out of the cut compartment and into a receiving and transferring unit. Conveying means leading to a further processing apparatus are located adjacent to the receiving and transferring unit and extend in a direction generally perpendicular thereto. The receiving and transferring unit is pivotally mounted on the support structure so that, after it receives the container ends, it is pivoted to a location next to the conveying means and the container ends are transferred to the conveying means.

BRIEF DESCRIPTION OF THE DRAWINGS

An illustrative and presently preferred embodiment of the invention is shown in the accompanying drawings in which.

DETAILED DESCRIPTION OF THE INVENTION

Figure 1:
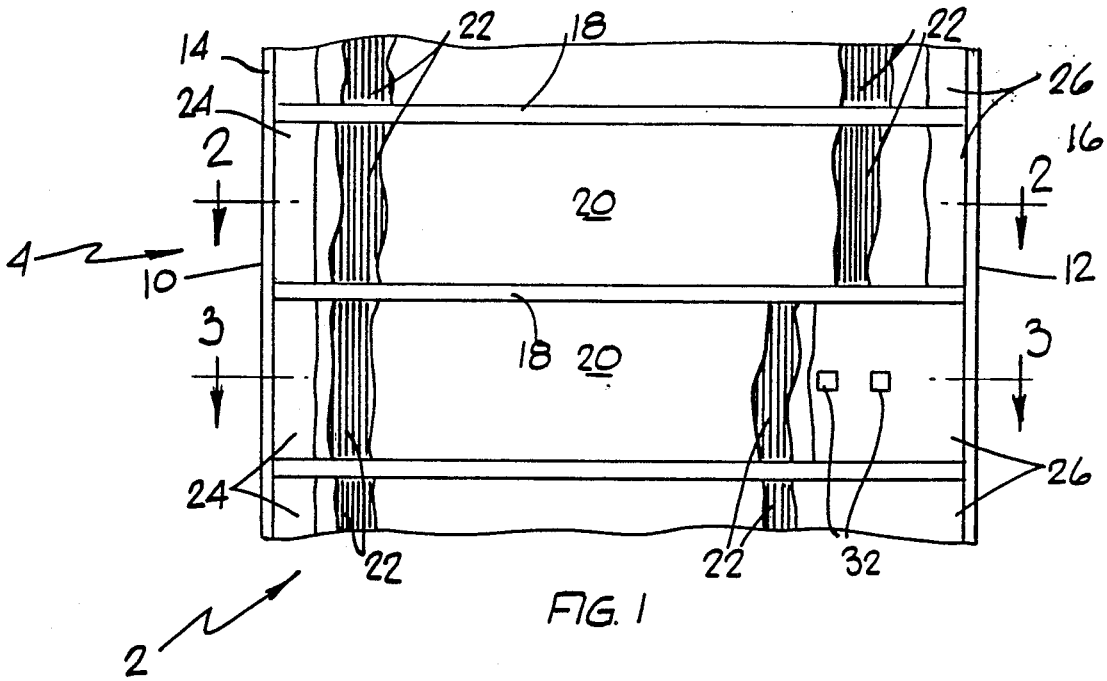
FIG. 1 is a top plan view of a portion of the package for use in the apparatus of this invention.
Figure 2:
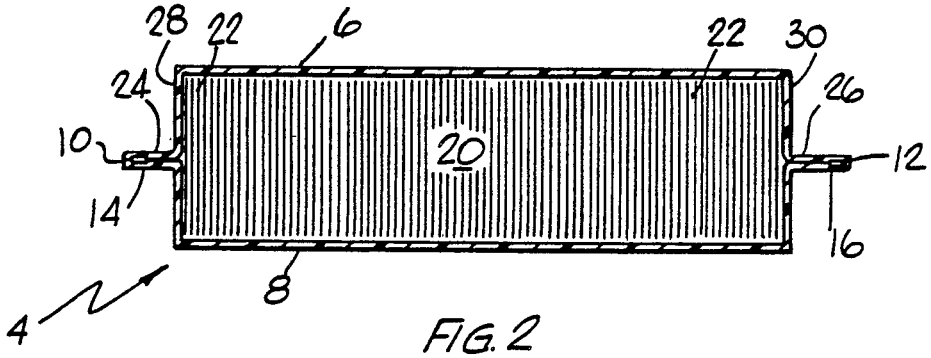
FIG. 2 is a cross-sectional view taken on the line 2—2 of FIG. 1.
Figure 3:
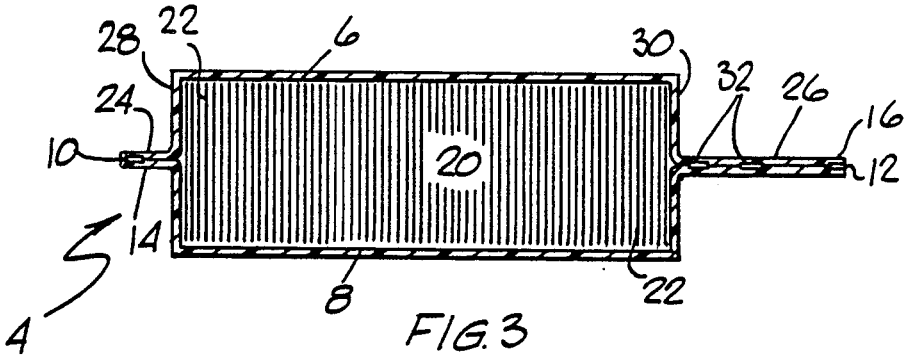
FIG. 3 is a cross-sectional view taken on the line 3—3 of FIG. 1.

In FIGS. 1-3, there is illustrated the package 2 for articles, hereinafter referred to as container ends, for use with the apparatus of this invention. The package 2 comprises a plurality of interconnected sealed compartments 4 which are formed by superposing two continuous webs 6 and 8 of a flexible material having opposite edges 10 and 12 and continuous end sealing strips 14 and 16 next adjacent the edges 10 and 12. A plurality of spaced apart, widthwise extending sealing strips 18 are formed from superposed portions of the two continuous strips 6 and 8. Each widthwise extending sealing strip 18 extends between and into the continuous end sealing strips 14 and 16. The widthwise extending sealing strips 18 and the continuous end sealing strips 14 and 16 are formed after the container ends have been positioned between superposed portions of the two continuous strips 6 and 8. As illustrated in FIGS. 2 and 3, each sealed compartment comprises a central body portion 20 in which the container ends 22 are confined and two opposite end portions 24 and 26, each of which comprises the portions of the two continuous strips 6 and 8 located between the continuous end sealing strips 14 and 16 and the central body portion 20.

The portions of the two continuous strips 6 and 8 forming the end portions 24 and 26 are crimped together prior to the formation of the continuous end sealing strips 14 and 16 so that they project sharply outwardly from the central body portion 20 and form end wall portions 28 and 30. Although the same number of identical container ends 22 are in each sealed compartment 4, the stack of container ends 22 may vary in length as illustrated in FIGS. 1-3. In such instances, one or more sealing spots 32 are formed so that the end portion 26 of a smaller central body portion 20 has a similar configuration, except for width, as the other end portion 26.

Figures 5, 5A:
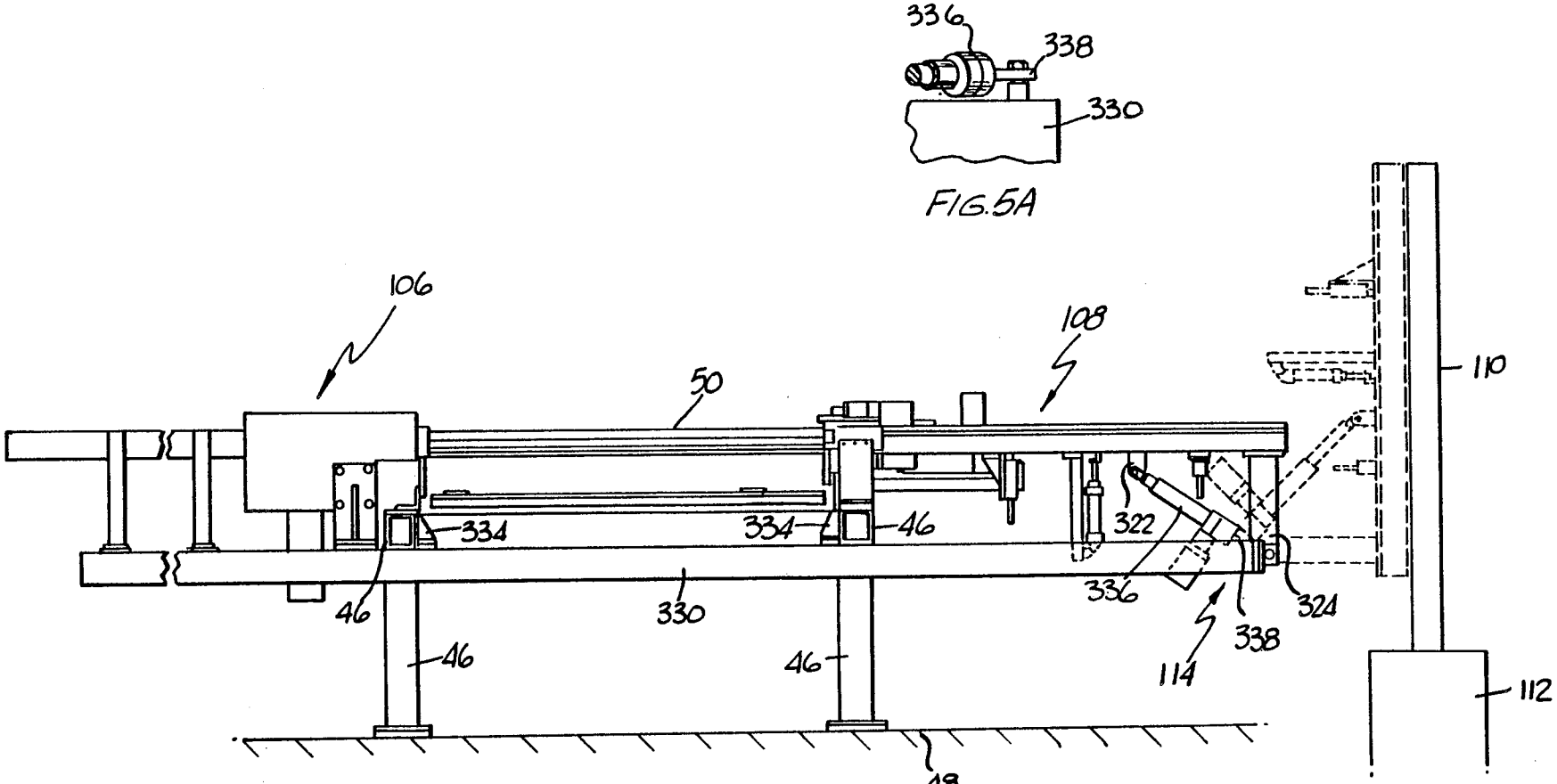
FIG. 5 is an end elevational view taken from the left side of FIG. 4.
FIG. 5A is a top plan view of a portion of FIG. 5.
Figure 6:
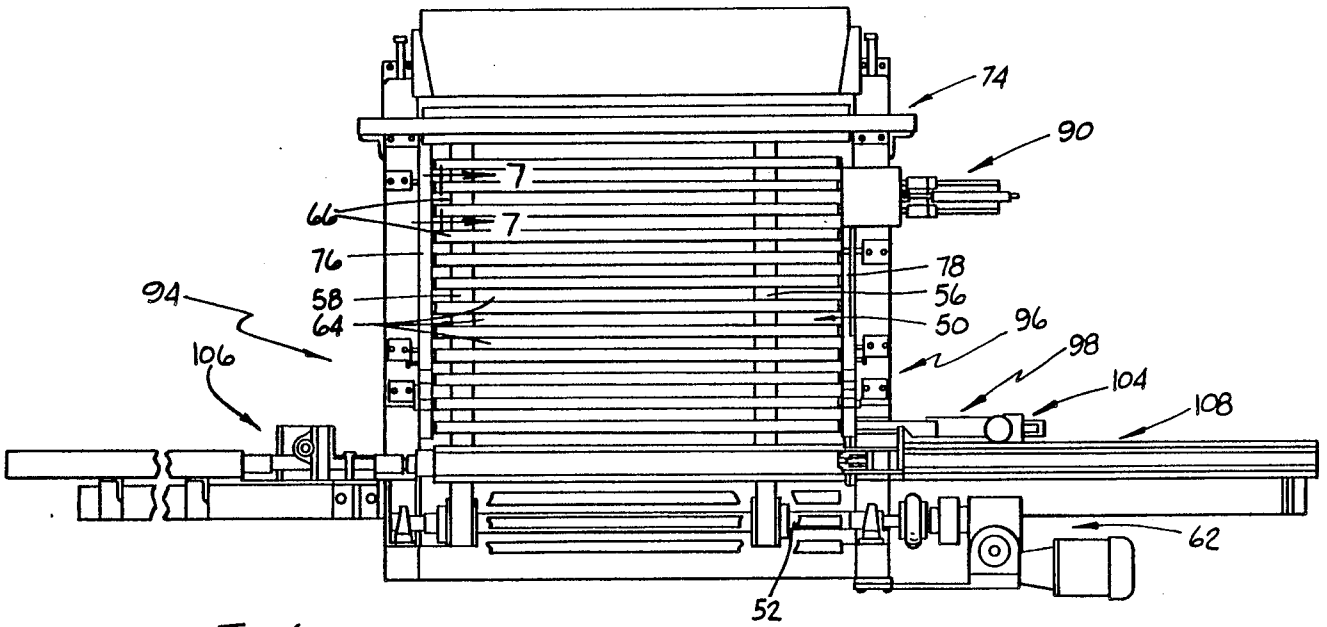
FIG. 6 is a top plan view of FIG. 5.
Figure 7:
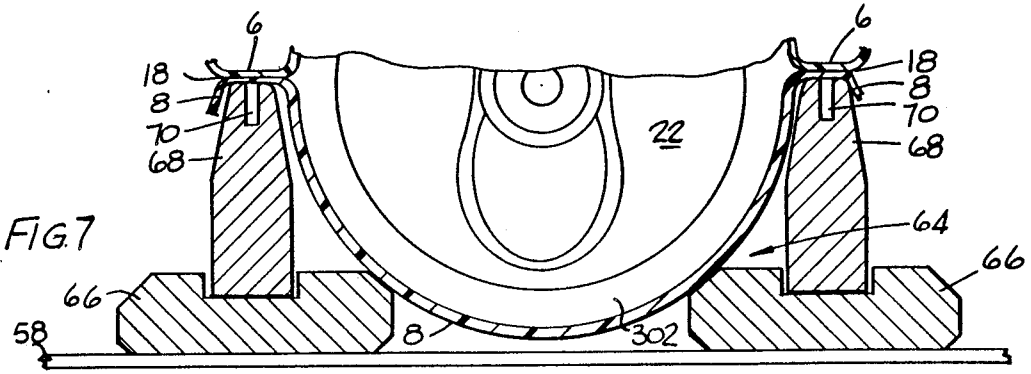
FIG. 7 is an enlarged cross-sectional view taken on the line 7—7 of FIG. 6 with a compartment and a container end added.

Apparatus for removing the container ends 22 from the sealed compartments 4 is illustrated in FIGS. 4-7. A pallet 40, having a package 2 supported thereon is supported on a support plate 42 which may be moved upwardly and downwardly by conventional indexing apparatus 44. The sealed compartments are pulled off of the palletized package 2 as described below. A fixed support structure 46 is mounted on a floor 48 of a building An endless conveyor 50 is journaled around a drive roll 52 and an idler roll 54. The endless roll 50 comprises a pair of spaced apart endless belts 56 and 58. The endless belts 56 and 58 are moved in incremental amounts in the direction indicated by the arrow by conventional indexing apparatus 62. While the endless conveyor 50 is moved in incremental amounts in the preferred embodiment of the invention, it is contemplated that the end conveyor can be continuously moving and the various operations are performed. Dividing means are provided for forming a plurality of holding units 64 and comprise bases 66, FIG. 7, which are secured on each of the endless belts 56 and 58 and a divider cog 68 fixedly secured in each base 66 and extending upwardly therefrom. Each base 66 and divider cog 68 extend in a widthwise direction which is perpendicular to the direction of movement of the endless belts 56 and 58. The divider cogs 68 are spaced apart so that the central body portion 20 is received therein. As illustrated in FIG. 7, the widthwise extending sealing strips 18 are in contact with the top surface of each divider cog 68. A widthwise extending slot 70 is formed in the top surface of the divider cog 68 so that a widthwise cut through the widthwise extending sealing strip 18 may be made if necessary. In operation, a few sealed compartments 4 are manually placed in the holding units 64 and thereafter, the indexing movement of the endless belts 56 and 58 will pull successive sealed compartments 4 off of the palletized package 2 for movement over a threshold plate 72 and into the holding units 64.

Figure 12:
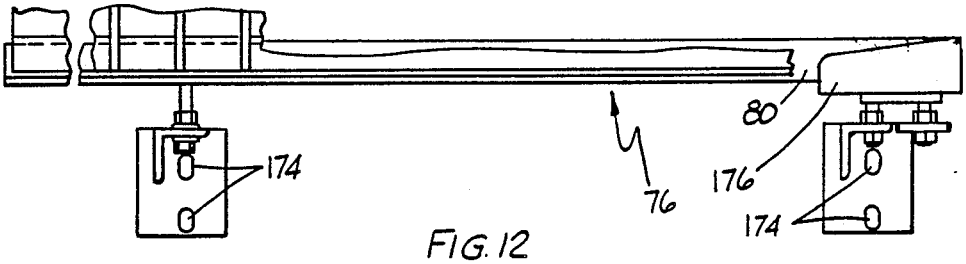
FIG. 12 is a top plan view of a side guide of FIG. 4 with portions of the sealed compartments added.
Figure 13:
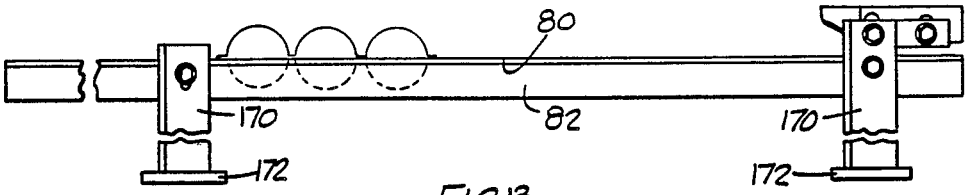
FIG. 13 is a side elevational view taken from the bottom side of FIG. 12.

As each sealed compartment 4 moves over a holding unit 64, it enters into a force applying station 74 wherein a force is applied thereto to ensure that the central body unit 20 moves into contact with the bases 66, described more fully below. A pair of side guides 76 and 78, FIG. 6, are fixedly mounted on the support structure 46. Side guide 76 is illustrated in FIGS. 12 and 13 and comprises a right angled bar having generally planar upper surface 80 and a generally planar surface 82 depending from the upper surface. The side guide 78 is of similar structure and is mounted so that the generally planar surfaces 80 lie in the same plane and the depending planar surfaces 82 are in a facing relationship. When the sealed compartments 4 are against the bases 66, the continuous end sealing strip 14 and the opposite end portion 24 overlie the generally planar surface 80 and end wall portion 28 is next adjacent to the planar surface 82. The same relationship exists between side guide 78 and the other side of the sealed compartments 4. At operating station 90, a force is applied against the end wall portion 30 to ensure that end wall portion 28 moves into contact with the planar surface 82 to ensure the above-described relationship.

The next operation station comprises a cutting operation 92 comprising a pair of housings 94, 96 in which are mounted knife means to sever the opposite end portions 24 and 26 so that the continuous end sealing strips 14 and 16 are removed. After the cutting operation, the endless conveyor 50 is indexed and a cut compartment is moved into a removal station 98. In the removal station, holding means are provided to prevent the widthwise movement of the cut compartment and comprise clamping means 100 apply a force on the widthwise extending sealing strips 18 on each side of a cut compartment 102 so that they are clamped between the clamping means 100 and the upper surface of successive divider cogs 68. A push back apparatus 104 applies a force on the end wall 30 to move the container ends 22 toward the end wall 28 and force apart the portions of the continuous strips 6 and 8 forming the end portion 24 to expose a portion of the end container end 22 in the cut compartment 102. Another force applying means 106 applies a force to the end container end 22 to push the container ends 22 out of the cut compartment 102 and onto a receiving and transferring unit 108. The container ends 22 are now available to be transferred to conveying means leading to other processing apparatus which in the preferred embodiment comprises a conveying chute 110 leading to seamer apparatus 112 is fixedly mounted to one side of the receiving unit 108 and is perpendicular thereto Pivot means 114, FIG. 5, are provided for pivoting the receiving and transferring unit 108 to a position where it is parallel to the conveying chute 110 and then the container ends 22 are pushed out of the receiving and transferring unit 108 into the conveying chute 110.

Figure 8:
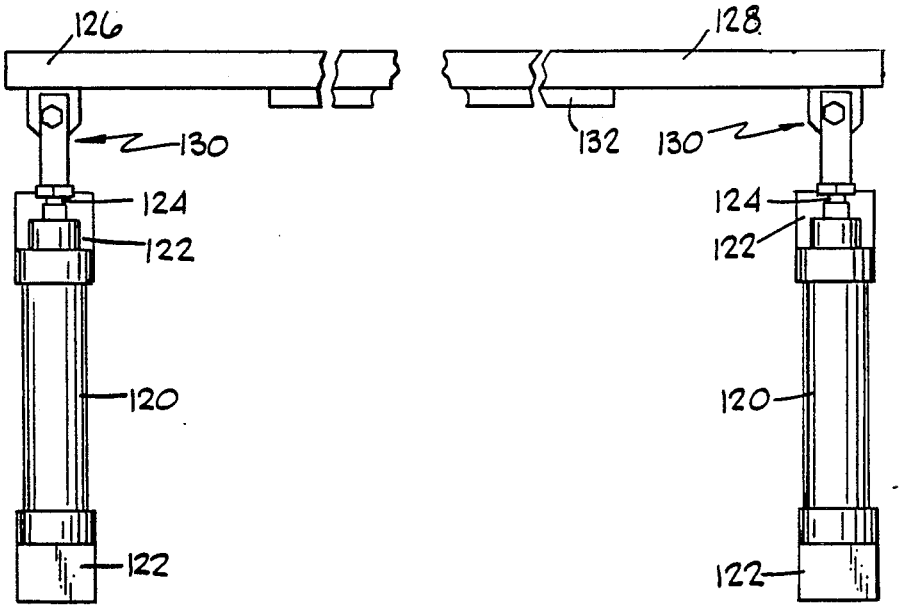
FIG. 8 is an end elevational view of guide apparatus of FIG. 1.
Figure 9:
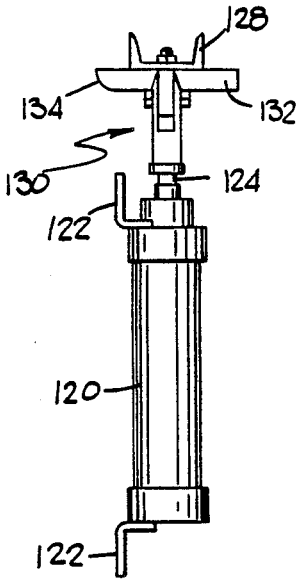
FIG. 9 is a side elevational view of FIG. 8.

The force applying station 74 is illustrated in FIGS. 8 and 9. A pair of air cylinders 120 are mounted by mounting brackets 122 on the support structure 46 on opposite sides of the endless conveyor 50. The piston rods 124 of the air cylinders 120 are connected to opposite ends 126 of a U-shaped channel 128 by bracket means 130. A guide member 132 is secured to the bottom surface of the U-shaped channel 128 and has a curved surface 134 for gradually applying a force on the sealed compartments 4 to move them downwardly on the bases 66. In operation, the guide member 132 is moved to an up or raised position by the air cylinders 120 so that the manual loading of a few sealed compartments 4 can be accomplished. The guide member 132 is then lowered to its operating position. As the endless conveyor 50 is moved, any sealed compartment 4 not in contact with the bases 66 will contact the curved surface 134 and be moved downwardly into contact with the bases 66.

Figure 10:
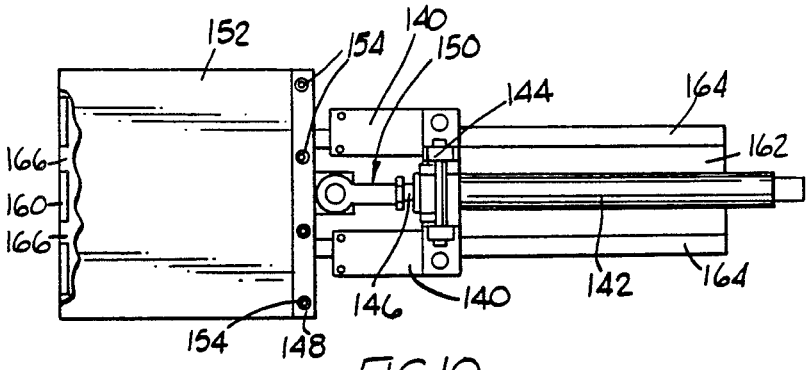
FIG. 10 is a top plan view of orienting apparatus of this invention.
Figure 11:
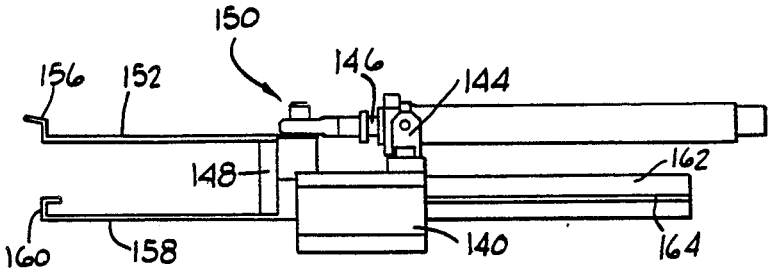
FIG. 11 is a side elevational view taken from the bottom side of FIG. 10.

The operating station 90 is illustrated in FIGS. 10 and 11. A pair bushings 140 are fixedly mounted on the support structure 46. An air cylinder 142 is mounted on the guide members 140 by mounting means 144. The piston rod 146 of the air cylinder 142 is connected to a cross bar 148 by connecting means 150. An upper push plate 152 is mounted on the cross bar 148 by threaded bolts 154 and has an angled end portion 156 adapted to contact an upper portion of the end wall portion 30. A lower push plate 158 is mounted on the cross bar 148 by threaded bolts (not shown) and has an angled end portion 160 adapted to contact a lower portion of the end wall portion 30. A slide guide assembly comprising a central body portion 162 and outwardly projecting side members 164 is mounted on the cross bar 148 and is slidably supported in the bushings 140. The upper and lower push plates 152 and 158 have a length in the direction of movement of the endless conveyor 50 of an extent to contact three sealed compartments 4. The air cylinder 142 is in a retracted position as the endless conveyor 50 is being moved. When the movement of the endless conveyor is stopped, the piston rod 146 will be extended so that the angled end portions 156 and 160 will contact upper and lower portions of the end wall portion 30 of the widest sealed compartment 4 of three successive sealed compartments 4 and push the end wall portion 28 into contact with the planar surface 82. The angled end portion 160 is provided with spaced apart cut out portions 166 large enough to accommodate the bases 66 so that the angled plate can contact a lower portion of the end wall portion 30. The opposite end portion 26 will be located between the upper and lower pusher plates 152 and 158. If three successive sealed compartments 4 are of the short type described above, the upper and lower pusher plates 152 and 158 have a width to accommodate the opposite side portion 26 having the one or more sealing spots 32.

The side guide 76, illustrated in FIGS. 12 and 13, is mounted on spaced apart support posts 170 extending from base members 172 having slots 174 for permitting passage of threaded bolts (not shown) for securing the base members 172 to the support structure 46. A guide assembly 176 is mounted on the support post 170 to ensure that the opposite end portion 24 is next adjacent to the planar surface 80. The side guide 78 is similar to the side guide 76 except that it is shorter in length by a distance equal to the length of the upper and lower pusher plates 152 and 158.

Figure 15:
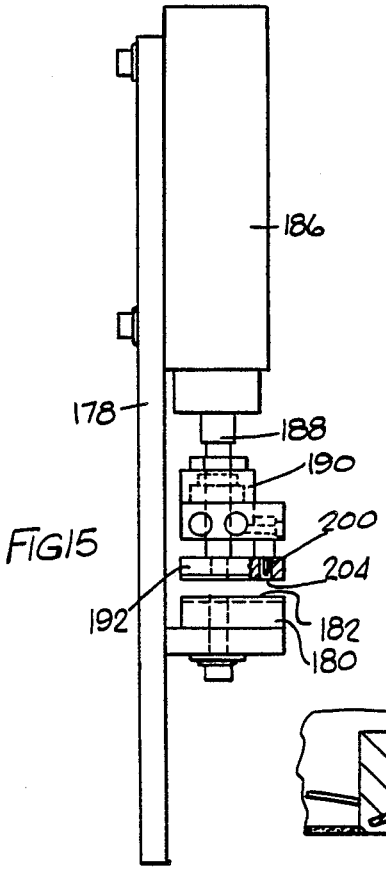
FIG. 15 is a side elevational view from the left side of FIG. 14.
Figure 16:
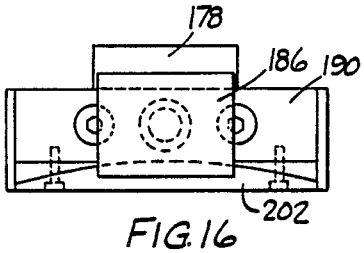
FIG. 16 is a top plan view of FIG. 14.
Figure 14:
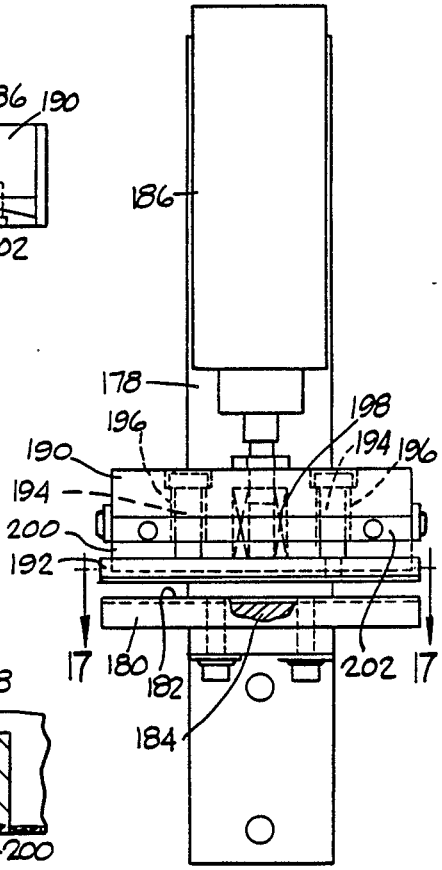
FIG. 14 is a front elevational view with parts in section of the cutting assembly of FIG. 4.
Figure 17:
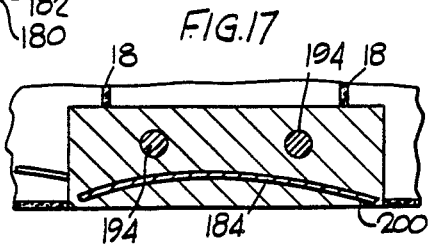
FIG. 17 is a cross-sectional view taken on the line 17—17 of FIG. 14.
Figure 18:
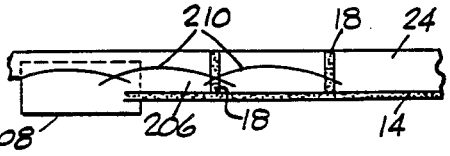
FIG. 18 is a top plan view of successively cut compartments.
Figure 19:
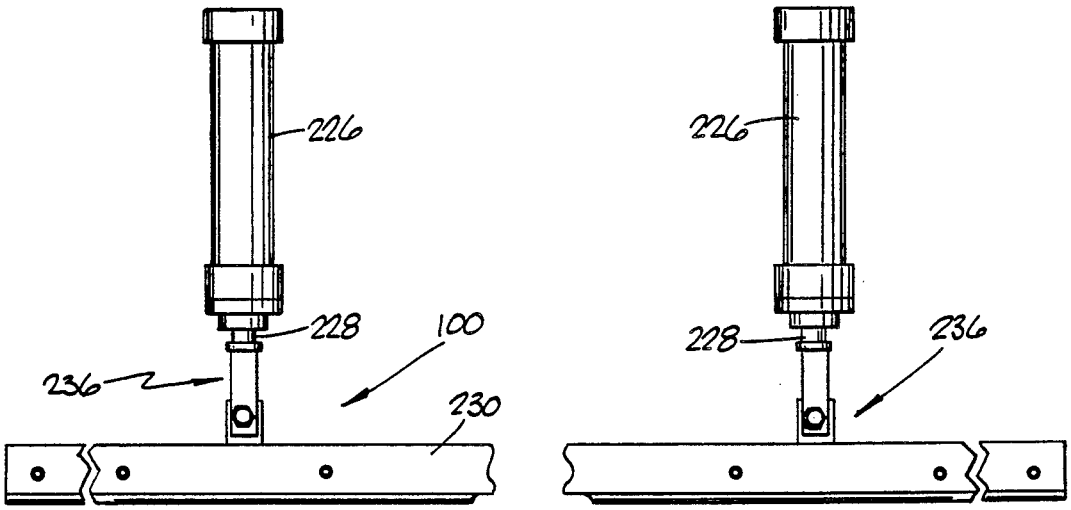
FIG. 19 is an end elevational view of the clamping means of FIG. 4.
Figure 20:
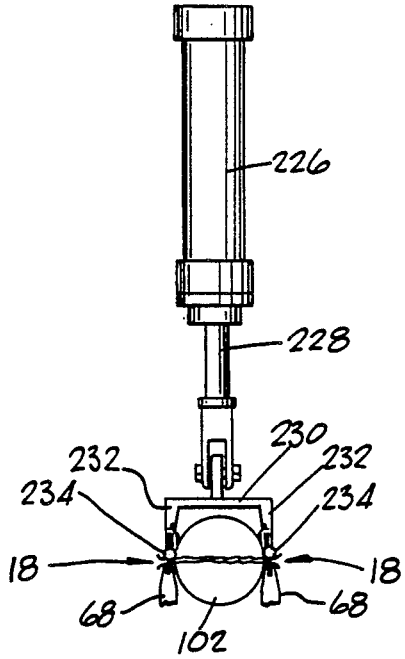
FIG. 20 is a side elevational view of FIG. 19 with added portions and the piston rod extended.

The apparatus at the cutting station 92 is illustrated in FIGS. 14–16 and will be explained relative to the cutting assembly 94. A support post 178 is secured to the support structure 46. A base plate 180 is fixedly mounted on the support post 178 and has an upper planar surface 182 lying in the same plane as the planar surface 80. A slot 184 extends downwardly from the upper planar surface 182 and extends in a lengthwise direction for a distance greater than the length of the incremental movement of the endless conveyor 50. An air cylinder 186 is fixedly mounted on the support post 178. The piston rod 188 of the air cylinder 190 is mounted on a block member 190 so that the block member 190 reciprocates in linear directions. A clamping block 192 is mounted on the block member 190 for movement therewith. A pair of headed bolts 194 pass through openings 196 in the block member 190 and are threadedly connected to the clamping block 192. A spring 198 is mounted between the block member 190 and the clamping block 192 to urge the clamping block 192 away from the block member 190 which movement is limited by the headed bolts 196. A cutting knife 200 is fixedly mounted on the block member 190 by a clamping plate 202. The mating surfaces of the block member 190 and clamping plate 202 are arcuate and the cutting knife 200 is formed from a flexible metallic material having a thickness of about 0.015 inch so that the cutting knife 200 is clamped into an arcuate shape. The clamping block 192 has a passageway 204 extending therethrough so that the cutting knife 200 can pass through the clamping block 192. The movement of the block member 190 and the clamping block 192 is controlled by the piston rod 188. During the movement of the endless conveyor, the block member 190 and the clamping block 192 will be in the up or raised position. When the movement of the endless conveyor 50 is stopped, the air cylinder 186 is actuated and the piston rod 188 moves the clamping block 192 into contact with the end portion 24 to clamp it between the clamping block 192 and the upper surface 182. The slot 184 is aligned with the passageway 204. The continued movement of the piston rod 188 moves the cutting knife 200 through the passageway 204 to contact and sever through the end portion 24 and move into the slot 184. The resilient spring 198 holds the clamping block 198 in clamping position during the cutting operation. The piston rod 188 then moves the block member 190 and the clamping block 192 to the up or raised position and the endless conveyor 50 is moved through the next incremental amount. During the movement of endless conveyor 50, the cut away portion 206 of the end portion 24 and the continuous end sealing strip 14 falls into a discharge chute 208. As illustrated in FIG. 17, the cutting knife 200 has an arcuate extent in the direction of movement of the endless conveyor that is greater than the length of the incremental movement of the endless conveyor 50 so as to overlap successive widthwise extending sealing strips 18. As illustrated in FIG. 18, the end portions of successive cuts 212 overlap. This ensures a continuous cutting away of the end portion 24 and the continuous end sealing strip 14. The cutting assembly 96 functions in the same manner to cut away a portion of the end portion 26 and the continuous end sealing strip 16.

Figure 4:
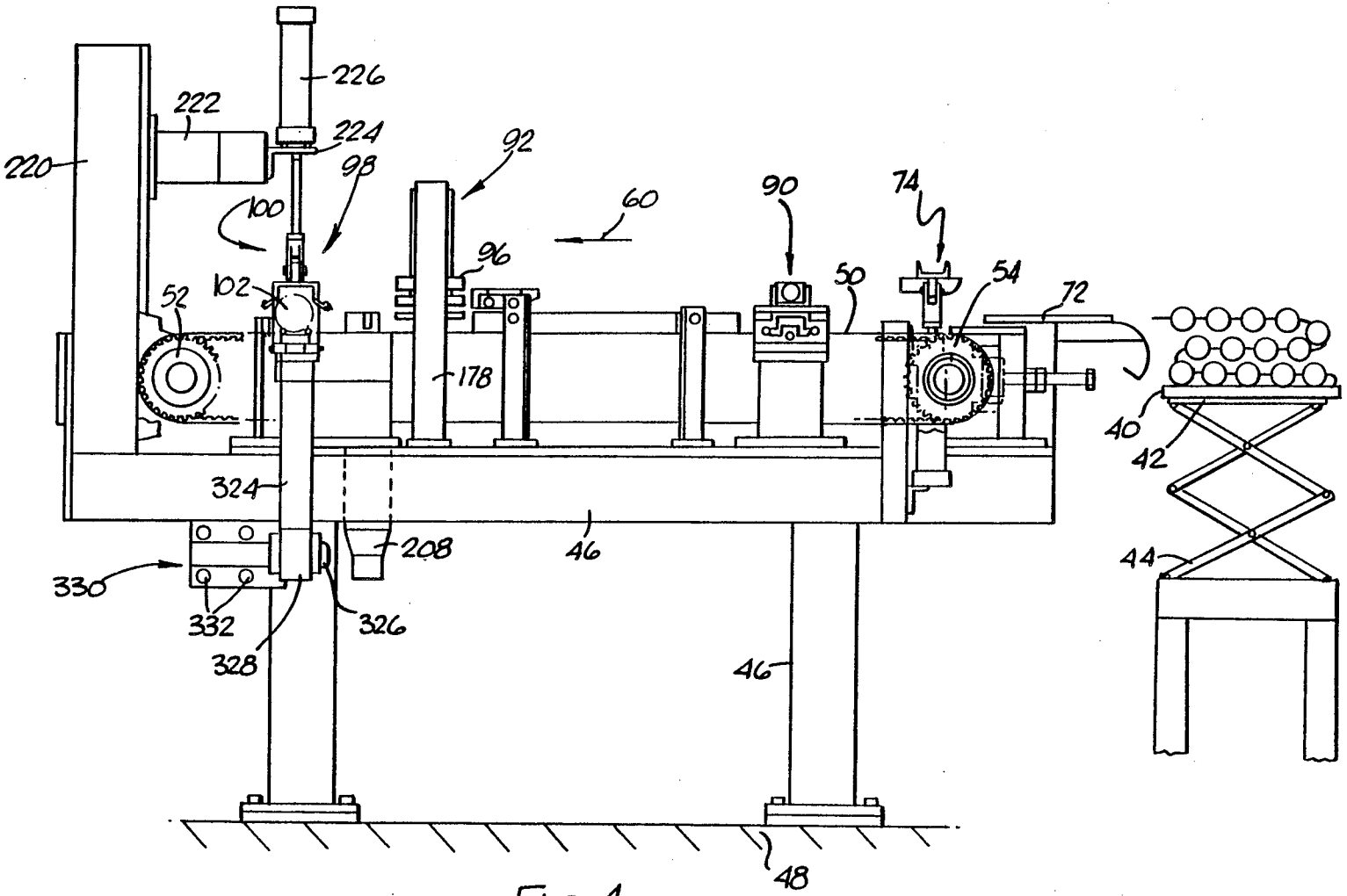
FIG. 4 is a side elevational view of apparatus of a preferred embodiment of the invention.

The apparatus at the removal station 98 is illustrated in FIGS. 19–27. A pair of spaced apart support posts 220, FIG. 4, are mounted on the support structure 46 and extend upwardly therefrom. A support member 222 extends outwardly from each support post 220 and has a mounting bracket 224 secured thereto. An air cylinder 226 is fixedly mounted on each mounting bracket 234 and has a piston rod 228 slidably mounted therein, FIGS. 17 and 18. The clamping means 100 comprises an elongated, inverted U-shaped channel 230 having leg portions 232 spaced a distance apart equal to the center-to-center distance between two successive widthwise extending sealing strips 18. A plastic strip 234 is secured to each leg portions 232. The inverted U-shaped channel 230 has a width substantial the same as the width of the divider cog 68. The inverted U-shaped member 230 is connected to the piston rods 228 by mounting means 236 for movement therewith. During the movement of the endless conveyor 50, the inverted U-shaped member 230 is in the up or raised position. When the movement of the endless conveyor 50 has stopped, the air cylinders 226 are actuated to move the piston rods 228 and the inverted U-shaped member 230 until the plastic strips 234 contact the widthwise extending sealing strips 18 on opposite sides of a cut compartment 102 to apply a force thereon to clamp the widthwise extending sealing strips 18 between the plastic strips 234 and the top surface of the divider cogs 68 to prevent widthwise movement of the cut compartment 102.

Figure 22:
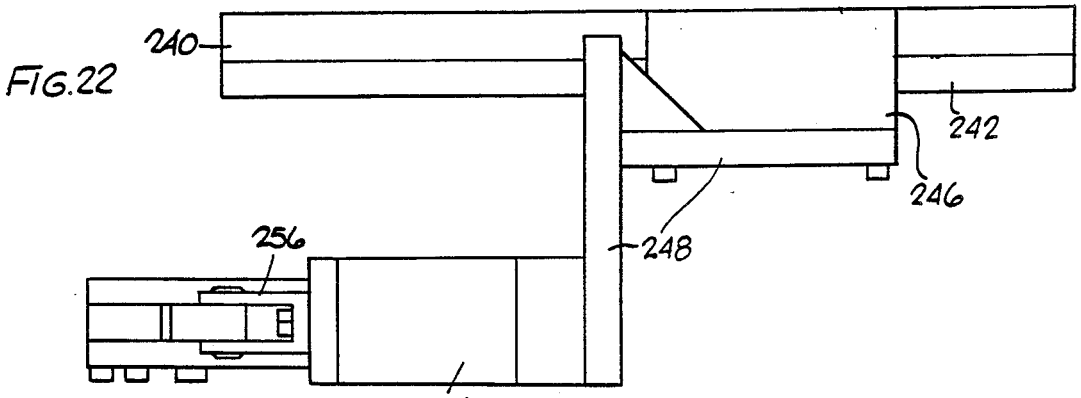
FIG. 22 is a top plan view of FIG. 21.
Figure 21:
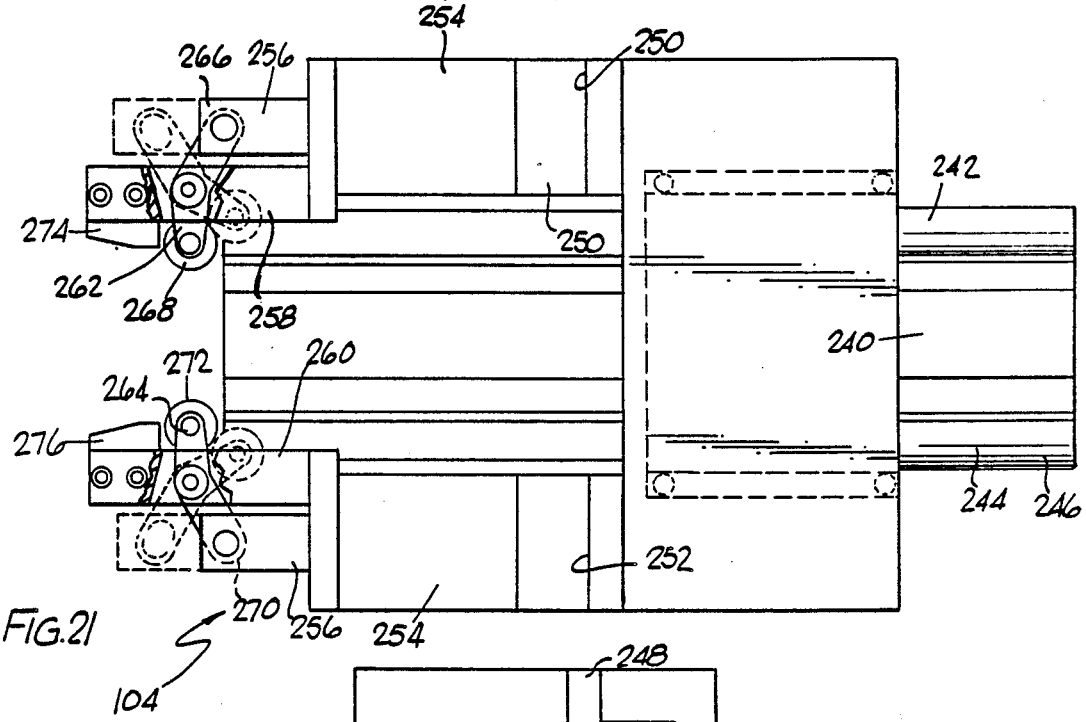
FIG. 21 is a side elevational view of the push back assembly of FIG. 4.
Figure 23:
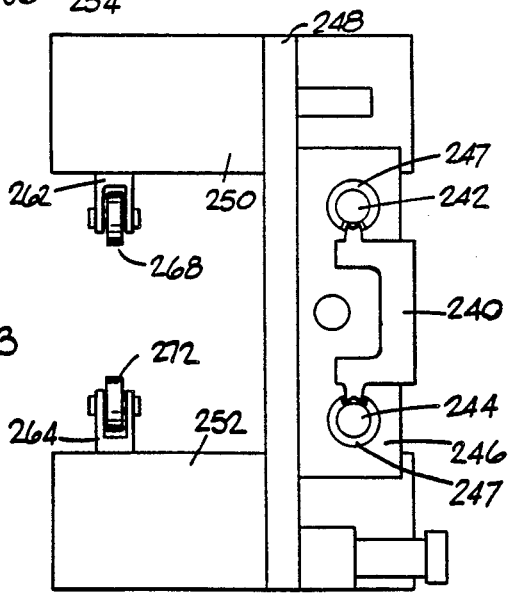
FIG. 23 is an end elevational view taken from the left side of FIG. 21.

The push back apparatus 104 is illustrated in FIGS. 21–23. A support beam 240 is fixedly mounted on the support structure 46 and has an upper rod 242 and a lower rod 244 secured thereto. A movable carriage 246, such as that marketed by Thompson under the trade designation Dual Shaft Rail System is mounted for movement over the rods 242 and 244 by a plurality of split bearings 247. A support assembly comprising a support member 248 is secured to the carriage 246 for movement therewith and has an upper mounting surface 250 and a lower mounting surface 252. An air cylinder 254 is mounted in each of the upper and lower mounting surface 250 and 252 and has a clevis 256 secured to its piston rod for movement therewith. An upper support arm 258 extends outwardly from the upper air cylinder 254 and a lower support arm 260 extends outwardly from the lower air cylinder 254. An upper lever 262 is pivotally mounted on the upper support arm 258 and a lower lever 264 is pivotally mounted on the lower support arm 260. One end 266 of the upper lever 262 is connected to the piston rod clevis 256 so that movement of the piston rod clevis 256 pivots the upper lever 262 and a contact roller 268 is mounted on the other end of the upper lever 262. One end 270 of the lower lever 264 is connected to the piston rod clevis 256 so that movement of the piston rod clevis 256 pivots the lower lever 264 and a contact roller 272 is mounted on the other end of the lower lever 264. Upper and lower guides 274 and 276 are mounted so as to ensure the proper location of the end wall 30. In operation, the contact rollers 268 and 272 are in the contacting relationship when the piston rods 256 are in a retracted position as illustrated by the solid outline in FIG. 21. With the endless conveyor in a stopped position, the carriage 246 is moved to move the contact rollers 268 and 272 against upper and lower portions of the end wall 30 of a cut compartment 102. This applies a force on the container ends 22 in the cut compartment 102 to force them against the end wall 28 of the cut compartment 102 to spread apart the end portion 24 and expose the end container end 22 in the cut compartment 102. The carriage 246 is then returned to its original retracted position and the air cylinders 25 are actuated to move the pistons 256 outwardly to pivot the upper and lower levers 262 and 264 and move the contact rollers 268 and 272 to a retracted position, illustrated by the dotted outline in FIG. 21, so that the container ends 22 can pass between them as they are moved out of the cut compartment 102.

Figure 24:
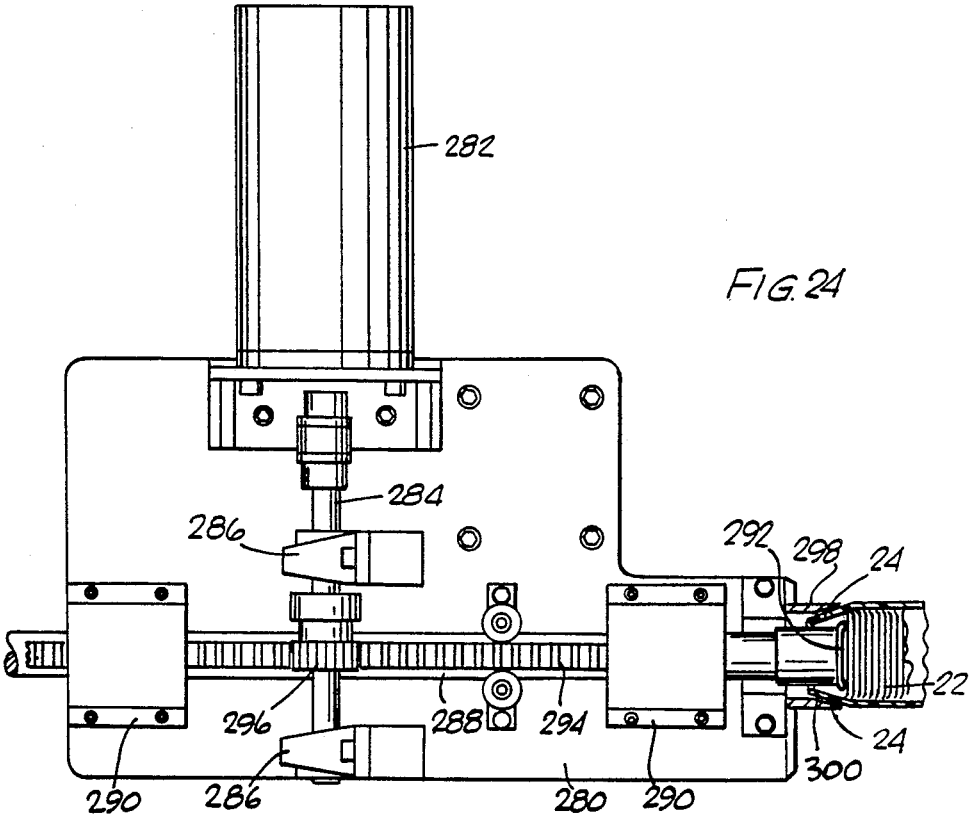
FIG. 24 is a top plan view of the push rod assembly of FIG. 4.
Figure 25:
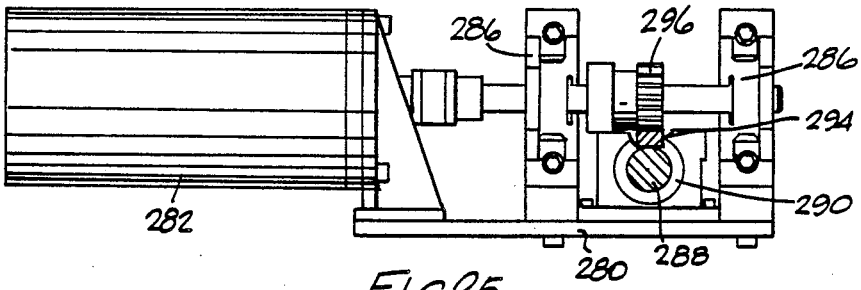
FIG. 25 is an end elevational view taken from the left side of FIG. 24.
Figure 26:
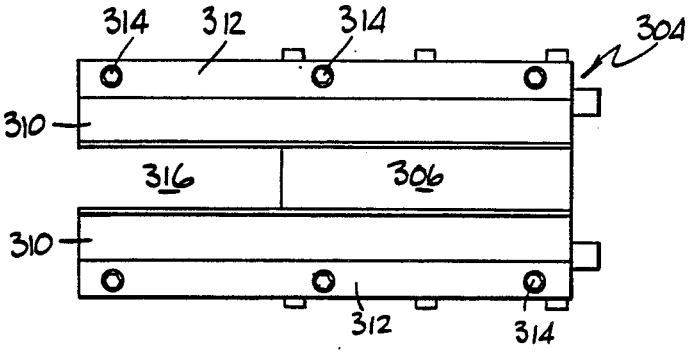
FIG. 26 is a top plan view of the stationary track of FIG. 4.
Figure 27:
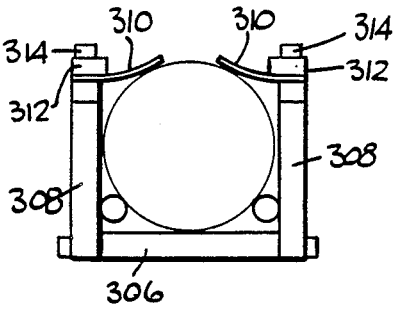
FIG. 27 is an end elevational view taken from the left side of FIG. 26.

The force applying means 106 is illustrated in FIGS. 24 and 25. A base plate 280 is fixedly mounted on the support structure 46. A motor 282 having a rotatable shaft 284 is mounted on the base plate 280. The rotatable shaft 284 is rotatably supported in spaced apart bearings 286 mounted on the base plate 280. A pusher rod 288 is slidably mounted in spaced apart bearings 290 and has an annular container end contacting member 292 secured thereto. The pusher rod 288 has a rack 294 secured thereto. A gear 296 is mounted on the shaft 284 for rotation therewith and is in mesh with the rack 294 so that rotation of shaft 284 moves the pusher rod 288 through the bearings 290. An end guide 298 is mounted on the base plate 280 and has an inclined surface 300 so that portions of the end portions 24 may be moved against it by the container ends 24 as a result of the push back operation. In operation, the container ends 22 have been moved to open the end portion 24 and are ready to be contacted by the annular container end contacting member 292 which is dimensioned to contact the end container end 302 at the portions next adjacent to the rim portion 302 thereof. The gear 296 and rack 294 function to move the pusher rod 288 through the cut compartment 102 to push all of the container ends 22 out of the cut compartment 102. As the container ends 22 are pushed out of the cut compartment 102, they pass through a stationary guide 304, illustrated in FIGS. 26 and 27. The stationary guide 304 has a fixed support plate 306 and a pair of spaced apart sidewalls 308 each having a flexible guide and container end restraining strip 310 secured thereto by a plate 312 and bolts 314. As illustrated in FIG. 26, the sidewalls 308 and the strips 310 extend beyond the support plate 306 to provide an opening 316 for the operation of the contact rollers 268 and 272 of the push back apparatus 104.

The receiving and transferring unit 108 is illustrated in FIGS. 4, 5 and 28–31. A support plate 320 is mounted on spaced apart supports 322 and 324. The support 324 is pivotally mounted on a pivot post 326 by a bearing 328. The pivot post 326 is mounted on a support member 330 by threaded bolts 332. The support member 330 is mounted on the support structure 46 by mounting brackets 334, FIG. 5. A force applying means 336, such as a ball screw linear actuator marketed by Duff-Norton, is pivotally mounted on the support 322 and on the pivot means 338 mounted on the support member 30, FIG. 5A.

Figures 28, 29, 30, 31:
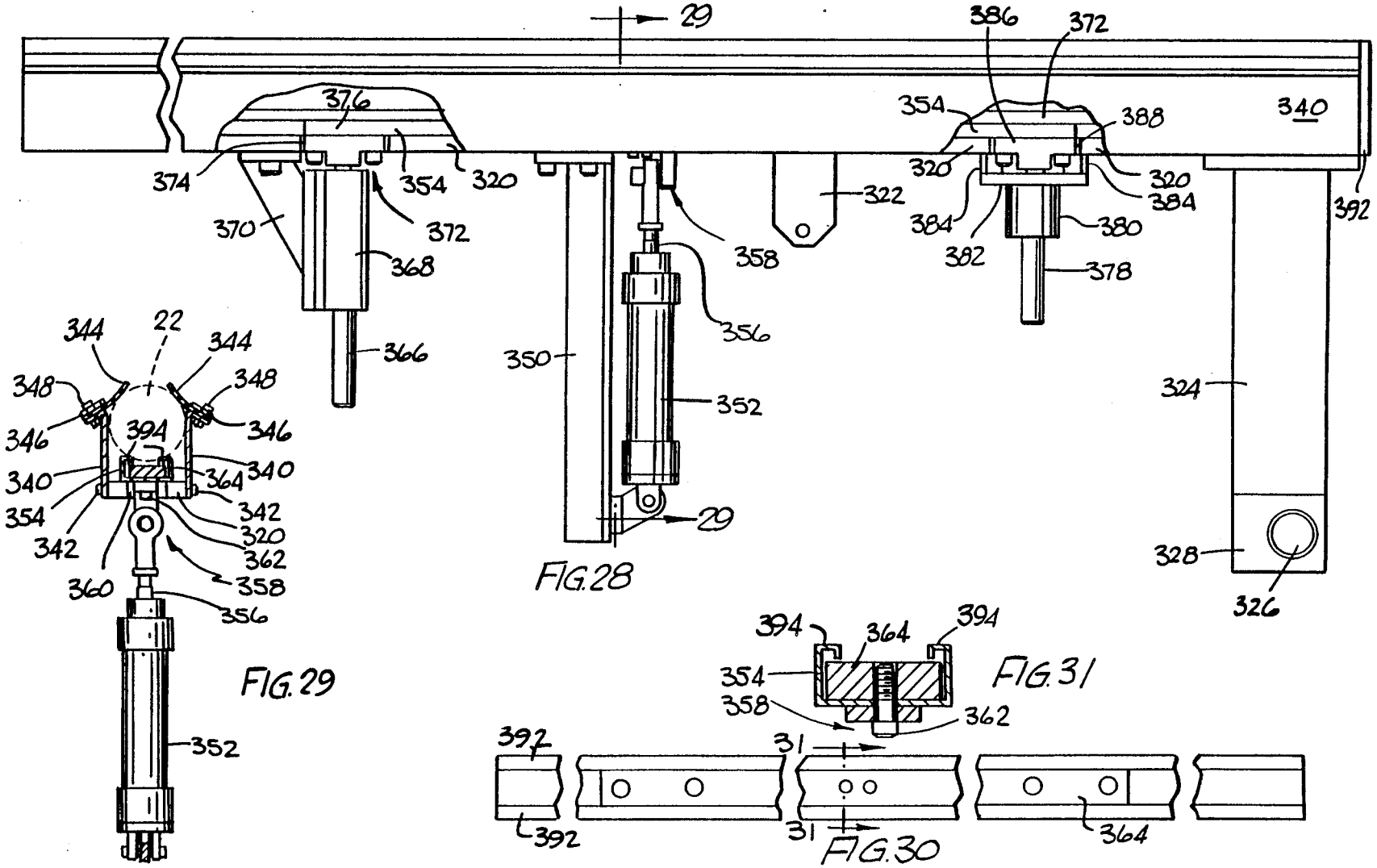
FIG. 28 is an end elevational view of the receiving and transferring apparatus of FIG. 4.
FIG. 29 is a cross-sectional view taken on the line 29—29 of FIG. 28.
FIG. 30 is a top plan view of a portion of FIG. 29.
FIG. 31 is a cross-sectional view taken on the line 31—31 of FIG. 30.

A pair of spaced apart sidewalls 340 are mounted on the support plate 320 by bolts 342, FIG. 29. Each of the sidewalls 340 has a flexible guide and container end restraining strip 344 secured thereto by a plate 346 and bolts 48 As illustrated in FIGS. 29–31, the guide and container end restraining strips 344 are angled upwardly from the sidewalls 340. A bracket 350 is mounted on the support plate 320 and has an air cylinder 352 mounted thereon. A generally U-shaped track member 354 is located above the support plate 320 and between the sidewalls 340 and is connected to the piston rod 356 by the connecting means 358 for movement therewith. The connecting means 358 pass through a cut-out portion 360 in the support plate 320 and are mounted by threaded bolts 362 to a block member 364 located within the U-shaped track member 354 so as to clamp a portion of the track member 354 therebetween for movement therewith. A first guide rod 366 is slidably mounted in a bearing 368 mounted on the support plate 320 by the bracket 370 and fixedly mounted on the track member 354 by the mounting means 372 which pass through a cut-out 374 in the support plate 320 and are secured to a block member 376 so as to clamp a portion of the track member 354 therebetween. The bearing 362 is a control bearing. A second guide rod 378 is slidably mounted in a bearing 380 mounted on the support plate 320 by threaded bolts passing through corner openings in the rectangular portion 382 of the bearing 380 and spacers 384 and secured in threaded openings in the support plate 320. The second guide rod 378 is mounted in the mounting means 386 which pass through a cut-out 388 in the support plate 320 and are secured to the block member 364 so as to clamp a portion of the track member 354 therebetween. An end closure plate 392 covers the opening between the sidewalls 340 to limit the movement of the container ends 22.

The operation of the receiving and transferring unit 108 is illustrated in FIGS. 5, 28 and 29. After passing through the stationary guide 304, the container ends 22 move onto the upper spaced apart surfaces 394 and are guided thereover by the strips 344 until they reach the end closure plate 392. The pusher rod 288 is then retracted back to its original location. When it is desired to transfer the container ends 22 to the conveying chute 110, the force applying means 336 are actuated to pivot the receiving and transferring unit 108 from the solid outline location in FIG. 5 to the dotted outline location parallel to the discharge tube 110. The air cylinder 352 is then actuated to move the track member 354 to move the container ends 22 through the flexible strips 344 into the conveying chute 110. The air cylinder 352 is actuated when the supply of container ends 22 in the conveying chute 110 is just below the end closure plate 392. After the container ends 22 have been transferred to the conveying chute 110, the air cylinder 352 is actuated to retract the track member 354 and the force applying means 336 are then actuated to pivot the receiving and transferring unit 108 back to the solid outline position of FIG. 5.

In the operation of a preferred embodiment of the invention, there are 505 container ends 22 in a sealed compartment 4. The distance between the edges 10 and 12 is about 49.5 inches and the distance between the edge 10 and the end wall portion 28 and between the edge 12 and the end wall portion is about 1.0 inches. The center to center distance between successive widthwise extending sealing strips 18 is 2.756 inches. Each of the continuous end sealing strips 14 and 16 has a width of about 0.375 inch. Each widthwise extending sealing strip 18 has a length in the direction of movement of the endless conveyor 50 of about 0.375 inch. The chord of the arcuate cutting knife is about 3.381 inches. The endless conveyor 50 is indexed in accordance with the rate of operation of the seamer apparatus 112. When used with a seamer apparatus operating at the rate of about 1,500 cans per minute, the endless conveyor will be indexed through a distance of 2.756 inches about every twenty seconds. During the movement of the endless conveyor 50, the upper and lower push plates 52 and 58 are in a retracted position; the cutting knife 200 is in the raised position; the clamping means 100 are in a raised position; the force applying means 104 are in a retracted position and the force applying means 106 are in a retracted position. The receiving and transferring unit 108 can be in any position during the movement of the endless conveyor 50 but must be in the receiving position, illustrated by the solid outline in FIG. 5, before the force applying means 106 can be moved to push the container ends out of the cut compartment 102. The emptied compartment moves with the endless conveyor 50 during subsequent indexing movements and falls into a waste hopper (not shown).

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. Apparatus for removing articles from a plurality of interconnected sealed compartments wherein each sealed compartment has a plurality of articles confined therein comprising:

a support structure mounted at a fixed location;

an endless conveyor mounted on said support structure and having an upper run and a lower run;

moving means for moving said endless conveyor;

said endless conveyor having a width extending perpendicular to the direction of movement of said endless conveyor;

dividing means extending in a widthwise direction on said endless conveyor for forming a plurality of holding units on said endless conveyor so that consecutive sealed compartments of said plurality of interconnected sealed compartments are located in consecutive holding units of said plurality of holding units;

each of said sealed compartments having a plurality of articles confined therein;

said plurality of interconnected sealed compartments being formed by two continuous webs of flexible material having spaced apart widthwise extending sealing strips and spaced apart, continuous lengthwise extending end sealing strips;

cutting means mounted on said support structure for cutting said two continuous webs of flexible material at locations between each continuous end sealing strip and said articles in said compartments to form a cut compartment;

holding means mounted on said support structure for holding said cut compartment at a fixed location;

first force applying means mounted on said support structure for contacting an end article in said held cut compartment and applying a force thereto to move said plurality of articles out of said held cut compartment;

a receiving and transferring unit mounted on said support structure for receiving said articles pushed out of said held cut compartment;

conveying means for conveying said articles to further processing apparatus; and transfer means mounted on said receiving and transferring unit for transferring articles from said receiving and transferring unit to said conveying means.

2. The invention as in claim 1 and further comprising:

second force applying means mounted on said support structure for applying a force on said sealed compartment in one of said holding units for ensuring that said sealed compartment is properly seated in said holding unit.

3. The invention as in claim 2 wherein said second force applying means comprises:

a widthwise extending beam having a lower surface adapted to contact one of said compartments; and moving means for moving said widthwise extending beam between upper position for permitting movement of said sealed compartments beneath said widthwise extending beam and a lower position for applying said force on one of said sealed compartments in said holding unit.

4. The invention as in claim 1 and further comprising:

a first elongated side guide located on one side of said endless conveyor and mounted on said support structure and having a length parallel to the direction of movement of said endless conveyor; and third force applying means mounted on said support structure for applying a force on said sealed compartment in said holding unit in a widthwise direction to force one end of said sealed compartment against said first elongated side guide to ensure proper orientation of said sealed compartment in said holding unit.

5. The invention as in claim 4 where said third force applying means comprises:

a pair of spaced apart bushings mounted on said support structure;

a support member mounted for reciprocal movement through said bushings;

a pair of spaced apart push plates mounted on said support member and located to be respectively moved over and under one of said end sealing strips; and moving means for reciprocating said pair of spaced apart push plates between a non-force applying position and a force applying position.

6. The invention as in claim 5 wherein:

said moving means comprises a fixedly mounted air cylinder.

7. The invention as in claim 5 and further comprising:

said first elongated side guide having a generally planar surface lying in a plane parallel to said upper run of said endless conveyor so that, when said end sealed compartment is pushed against said first elongated side guide, the other of said end sealing strips of said sealed compartment in said holding unit is located over at least a portion of said generally planar surface.

8. The invention as in claim 7 and further comprising:

a second elongated side guide mounted on said support structure and located on the other side of said endless conveyor; and said second elongated side guide having a generally planar surface lying in the same plane as said generally planar surface of said first elongated side guide so that, when said sealed compartment is pushed against said first elongated side guide, said one of said end sealing strips of said sealed compartment in said holding unit is located over at least a portion of said generally planar surface of said second elongated side guide.

9. The invention as in claim 8 and further comprising:

guide means mounted on said support structure and located above a portion of each of said generally planar surfaces and next adjacent to said cutting means for guiding said one and said other of said end sealing strips into said cutting means.

10. The invention as in claim 8 and further comprising:

fourth force applying means mounted on said support structure for applying a force on said articles in said held cut compartment to expose the end article in said clamped cut compartment so that it can be contacted by said first force applying means.

11. The invention as in claim 10 wherein said fourth force applying means comprises:

a guide rail mounted on said support structure and extending in a direction parallel to said widthwise direction;

a support member mounted for reciprocal sliding movement over said guide rail;

an upper arm fixedly mounted on said support member for movement therewith;

an upper lever pivotally mounted on said upper arm for movement between an operative position and a non-operative position;

a lower arm fixedly mounted on said support member for movement therewith;

a lower lever pivotally mounted on said lower arm for movement between an operative position and an non-operative position;

drive means for moving said support member over said guide rail; and moving means for pivoting said upper and lower levers.

12. The invention as in claim 11 wherein said moving means comprise:

a first air cylinder mounted on said upper arm and pivotally connected to one end of said upper lever; and a second air cylinder mounted on said lower arm and pivotally connected to one end of said lower lever.

13. The invention as in claim 12 and further comprising:

a roller rotatably mounted on the other end of said upper and lower levers.

14. The invention as in claim 13 and further comprising:

a stationary track mounted on said support structure for guiding said articles as they are moved out of said cut compartment and onto said receiving and transferring unit.

15. The invention as in claim 14 wherein said stationary track comprises:

a base fixedly mounted on said support structure;

a pair of spaced apart sidewalls projecting upwardly from said base and extending in said widthwise direction of said endless conveyor;

each of said sidewalls having a width greater than the width of said base so that portions of said sidewalls project outwardly from said base in a widthwise direction of said endless conveyor; and said upper and lower levers being located between said sidewalls when in said operative positions.

16. The invention as in claim 1 wherein:

said upper run lies in a generally horizontal plane.

17. The invention as in claim 1 wherein said endless conveyor and said dividing means comprise:

a pair of spaced apart parallel endless belts;

a plurality of base members secured on said endless belts in spaced apart parallel relationship so that successive base members support one of said sealed compartments;

each of said base members having a length extending in the direction of movement of said endless conveyor;

a dividing member projecting upwardly from each base member and having a length extending in the direction of movement of said endless conveyor that is substantially less than said length of said base member; and said dividing member having an upper surface located to contact at least a portion of a widthwise extending sealing strip when said one of said compartments is in contact with said adjacent base members.

18. The invention as in claim 1 wherein said cutting means comprises:

a pair of spaced apart support posts fixedly mounted on said support structure and extending upwardly therefrom;

a base plate mounted on each of said support posts and having a generally planar upper surface for supporting said end sealing strips and the portions of said two continuous webs between said end sealing strips and said articles;

each of said upper surfaces having a slot formed thereon and extending generally in a direction parallel to said direction of movement of said endless conveyor;

a cutting assembly mounted on each of said support posts; and knife means slidably mounted in said cutting assembly for reciprocating movement into or out of said slot.

19. The invention as in claim 18 wherein each of said knife means comprises:

a block member having a pair of spaced apart openings extending therethrough;

a clamping block having a lower surface facing said upper surface of said base plate member;

a pair of spaced apart bolts extending through said opening in said clamping block and secured to said clamping block;

resilient means for urging said clamping block in a direction away from said block member;

stop means for limiting the movement of said clamping block away from said block member;

a knife fixedly mounted on said block member for movement therewith;

a slot extending through said clamping block; and moving means for moving said block member relative to said support post in a direction toward or away from said base plate member.

20. The invention as in claim 19 and further comprising:

said knife, said slot in said base plate and said slot in said clamping block each having an arcuate cross-sectional configuration, the chords of which extend in a direction parallel to said direction of movement of said endless conveyor.

21. The invention as in claim 20 wherein:

said knife having an arcuate extent greater than said incremental amount of movement.

22. The invention as in claim 21 wherein:

said moving means moving said clamping block into contact with said end sealing strip and said portions of said two continuous webs between said end sealing strip and said articles to apply a clamping force thereon; and said moving means overcoming said resilient means to move said knife through said portions of said two continuous webs to sever said end sealing strip therefrom.

23. The invention as in claim 1 wherein said holding means comprises:

a U-shaped member mounted on said support structure for movement toward or away from said dividing means;

said U-shaped member mounted so that the open end thereof faces said cut compartment;

the legs of said U-shaped member being spaced apart a distance equal to the center-line to center-line distance between adjacent widthwise extending sealing strips; and moving means for moving said U-shaped member to clamp said widthwise extending sealing strips between said dividing means and said legs.

24. The invention as in claim 23 wherein said moving means comprises:

a pair of air cylinders having the cylinder portions thereof fixedly mounted on said support structure and the piston portions thereof connected to said U-shaped member.

25. The invention as in claim 24 wherein:

said piston portions are pivotally connected to said U-shaped member so that the pivotal axes thereof extend in directions generally parallel to the direction of movement of said endless conveyor.

26. The invention as in claim 1 wherein said first force applying means comprises:

a base plate fixedly mounted on said support structure;

a pusher rod having a longitudinal axis extending parallel to said widthwise direction and mounted on said base plate for permitting linear sliding movement of said pusher rod relative thereto;

said articles in said cut compartment having a longitudinal axis;

mounting means for mounting said pusher rod on said base plate so that said longitudinal axis thereof is aligned with said longitudinal axis of said articles; and moving means for moving said pusher rod in reciprocal directions between a retracted position and a fully extended position that ensures that all of said articles are pushed out of said held cut compartment.

27. The invention as in claim 26 and further comprising:

a push back assembly for applying a force on said articles in said held cut compartment to move said articles in the direction of said pusher rod so as to expose at least a portion of the surface of the end article facing said pusher rod so that said pusher rod can contact said surface and apply a force thereto to move said articles out of said held cut compartment.

28. The invention as in claim 27 wherein said push back assembly comprises:

a guide rail mounted on said support structure and extending in a direction parallel to said widthwise direction;

a support member mounted for reciprocal sliding movement over said guide rail;

an upper arm fixedly mounted on said support member for movement therewith;

an upper lever pivotally mounted on said upper arm for movement between an operative position and a non-operative position;

a lower arm fixedly mounted on said support member for movement therewith;

a lower lever pivotally mounted on said lower arm for movement between an operative position and an non-operative position;

drive means for moving said support member over said guide rail; and pivotal moving means for pivoting said upper and lower levers.

29. The invention as in claim 28 wherein said pivotal moving means comprises:

a first air cylinder mounted on said upper arm and pivotally connected to one end of said upper lever; and a second air cylinder mounted on said lower arm and pivotally connected to one end of said lower lever.

30. The invention as in claim 29 wherein said articles comprise:

ends for containers;

said ends having a rim portion; and an annular end portion on said push rod located to contact portions of said end container end next adjacent to said rim portion.

31. The invention as in claim 30 wherein said moving means comprises:

a drive motor mounted on said base plate and having a shaft extending outwardly therefrom and rotated by said drive motor;

a gear mounted on said shaft for rotation therewith; and an elongated rack mounted on said pusher rod and in engagement with said gear so that rotation of said gear moves said rack and said pusher rod.

32. The invention as in claim 1 wherein said receiving and transferring unit comprises:

a support member;

pivot means for pivotally mounting said support member on said support structure;

article support means mounted on said support member for contacting bottom portions of said articles for supporting said articles and extending in a direction parallel to said widthwise direction;

top guide means for contacting top portions of said articles as they are pushed over said elongated article support means;

said top guide means having exit forming means for permitting said articles to be pushed therethrough;

said conveying chute having a longitudinal axis;

said conveying chute having an entrance portion extending in a direction parallel to its longitudinal axis;

moving means for applying a force to said support member to pivot said support member around said pivot means so that said exit forming means are facing said entrance portion; and pushing means for applying a force on said articles in said receiving and transferring unit to push them through said exit forming means and said entrance portion into said conveying chute.

33. The invention as in claim 32 wherein said pushing means comprises:

mounting means for mounting said support means for reciprocal movement away from or back to said support member; and moving means for applying forces on said article support means to move said article support means away from or back to said support member.

34. Method for removing articles from a package having the articles confined in interconnected sealed compartments formed by superposing two continuous webs of a flexible material and forming continuous end sealing strips next adjacent to the edges thereof and a plurality of spaced apart widthwise extending sealing strips extending between and into said continuous end sealing strips after the articles have been positioned between portions of the two continuous webs so that each sealed compartment has a central body portion having opposite end wall portions and in which the articles are confined and two opposite end portions comprising portions of the two continuous webs located between an end wall portion of the central body portion and a continuous end sealing strip using an movable endless conveyor which has a plurality of holding units formed thereon which holding units extend in a widthwise direction which is perpendicular to the direction of movement of the endless conveyor comprising:

feeding said package onto said endless conveyor so that each sealed compartment is received in a holding unit so that the end portions and the continuous end sealing strips of each sealed compartment project outwardly from each side of said endless conveyor;

cutting said opposite end portions of said superposed continuous webs of said sealed compartment in said holding unit to separate said continuous end sealing strips therefrom;

holding said widthwise extending sealing strips on either side of a cut compartment to prevent widthwise movement of said cut compartment;

applying a force on an end article to move said articles out of said held compartment and into a receiving and transferring unit; and transferring said articles from said receiving and transferring unit into conveying means further processing operations.

35. The method as in claim 34 and further comprising:

applying a push back force on said articles in said held compartment prior, to and in a direction opposite to said step of applying a force, to expose a surface of an article so that said force can be applied thereto.

* * * * *